US006218920B1

(12) United States Patent
Reichard et al.

(10) Patent No.: US 6,218,920 B1
(45) Date of Patent: Apr. 17, 2001

(54) CIRCUIT BREAKER WITH ADJUSTABLE MAGNETIC TRIP UNIT

(75) Inventors: Matthias Reichard; Walter Felden, both of Neumunster (DE)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/494,853

(22) Filed: Feb. 1, 2000

(30) Foreign Application Priority Data

Feb. 1, 1999 (DE) ..... 199 03 911

(51) Int. Cl.[7] ..... H01H 9/00
(52) U.S. Cl. ..... 335/176; 335/37; 335/172
(58) Field of Search ..... 335/23–25, 35–45, 335/167–176

(56) References Cited

U.S. PATENT DOCUMENTS

| | | | | |
|---|---|---|---|---|
| 3,421,123 | | 1/1969 | Johnson et al. . | |
| 3,575,679 | * | 4/1971 | Ellsworth et al. | 335/176 |
| 3,593,234 | * | 7/1971 | Charbonneau | 335/42 |
| 3,855,557 | * | 12/1974 | Gryotko | 335/42 |
| 3,936,780 | * | 2/1976 | Hennemann | 335/23 |
| 4,983,939 | * | 1/1991 | Shea et al. | 335/42 |
| 5,467,069 | * | 11/1995 | Payet-burin et al. | 335/42 |
| 5,508,670 | * | 4/1996 | Mantzouridis et al. | 335/172 |
| 5,608,367 | * | 3/1997 | Zoller et al. | 335/132 |

FOREIGN PATENT DOCUMENTS 1 588 732 6/1967 (DE) .

* cited by examiner

*Primary Examiner*—Lincoln Donovan
*Assistant Examiner*—Tuyen T. Nguyen
(74) *Attorney, Agent, or Firm*—Cantor Colburn LLP; Carl B. Horton

(57) ABSTRACT

An adjustable magnetic trip unit for a circuit breaker (1) is equipped with a magnet yoke (16), an armature element (18) that works therewith to actuate a trip shaft (14), and an adjusting bar (23) that can be tilted about the axis (15) of the trip shaft (14) for adjusting the distance (L) between the magnet yoke (16) and the armature element (18). This magnetic trip unit can be used in a circuit breaker (1) having a plurality of breaker cassettes (30) arranged adjacent to one another wherein the adjusting bar (23) extends parallel to the axis (15) of the tripping shaft (14) and on which are arranged a plurality of adjusting arms (24) corresponding to the number of breaker cassettes (30).

10 Claims, 3 Drawing Sheets

CIRCUIT BREAKER WITH ADJUSTABLE MAGNETIC TRIP UNIT

BACKGROUND OF THE INVENTION

The invention relates to circuit breakers with a magnetic trip unit, and, more particularly, to circuit breakers with an adjustable magnetic trip unit.

Circuit breakers typically provide protection against the very high currents produced by short circuits. This type of protection is provided in many circuit breakers by a magnetic trip unit, which trips the circuit breaker's operating mechanism to open the circuit breaker's main current-carrying contacts upon a short circuit condition.

Modern magnetic trip units include a magnet yoke (anvil) disposed about a current carrying strap, an armature (lever) pivotally disposed near the anvil, and a spring arranged to bias the armature away from the magnet yoke. Upon the occurrence of a short circuit condition, very high currents pass through the strap. The increased current causes an increase in the magnetic field about the magnet yoke. The magnetic field acts to rapidly draw the armature towards the magnet yoke, against the bias of the spring. As the armature moves towards the yoke, the end of the armature contacts a trip lever, which is mechanically linked to the circuit breaker operating mechanism. Movement of the trip lever trips the operating mechanism, causing the main current-carrying contacts to open and stop the flow of electrical current to a protected circuit.

It is necessary for such magnetic trip units to be reliable. In addition, it is desired that magnetic trip units be adjustable, so that the breaker can be adjusted to trip at different levels of overcurrent. It is also desired that the magnetic trip units be compact.

BRIEF SUMMARY OF THE INVENTION

In an exemplary embodiment of the invention, a circuit breaker with adjustable magnetic trip unit includes a magnet yoke disposed proximate to an electrically conductive strap, and an armature pivotally disposed proximate to the magnet yoke. A trip shaft is configured to interact with a latching mechanism of the circuit breaker. The trip shaft has a cam extending therefrom, with the cam being arranged proximate to the armature. An adjusting bar is arranged to pivot around the trip shaft. The adjusting bar includes an adjusting arm extending therefrom. The adjusting arm contacts the armature for adjusting the distance between the magnet yoke and the armature.

DETAILED DESCRIPTION OF THE INVENTION

Figure 1:
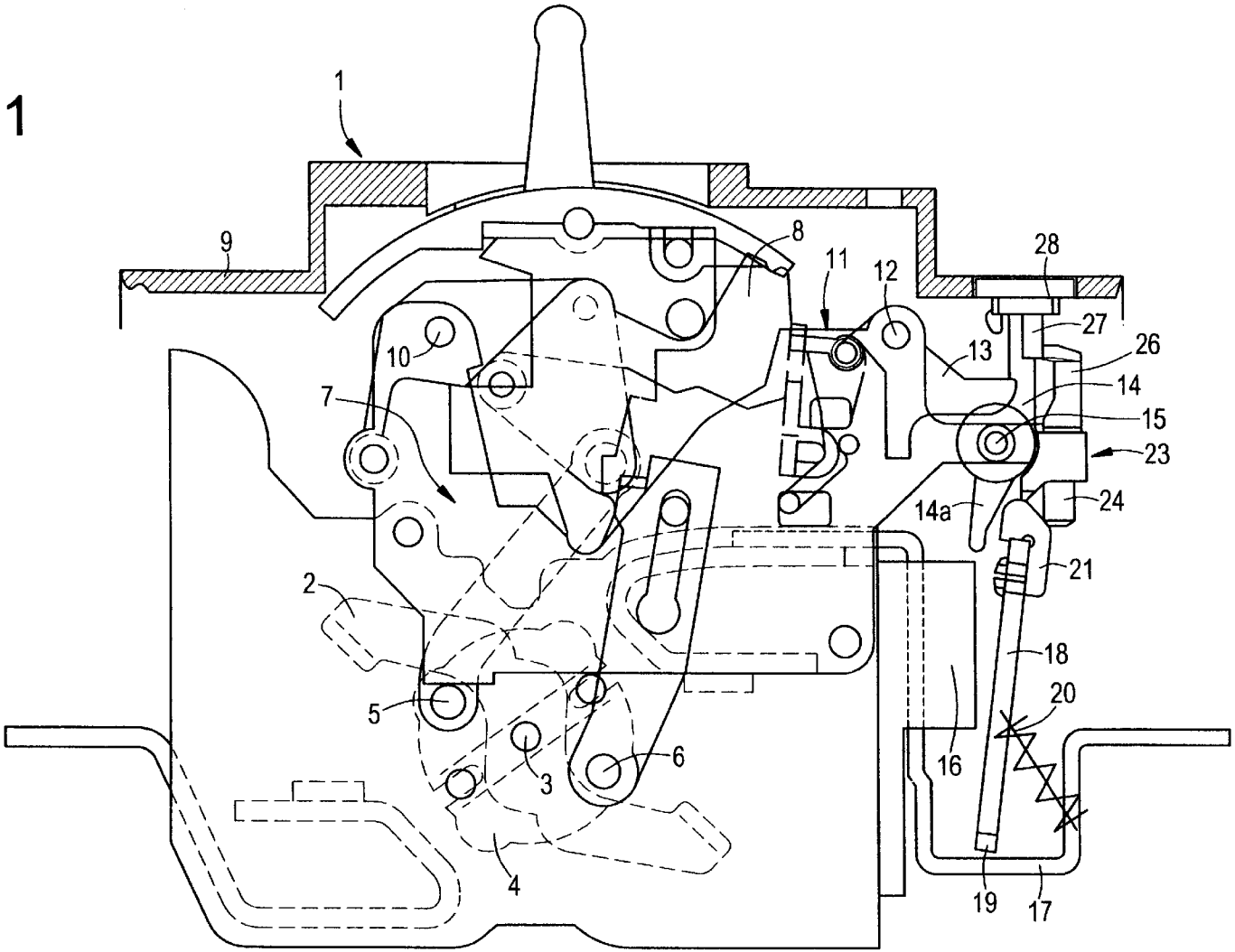
FIG. 1 is an elevation view of a circuit breaker with a magnetic trip unit of the present invention.

A circuit breaker 1 equipped with the adjustable magnetic trip unit of the present invention is shown in FIG. 1. The circuit breaker 1 has a rotary contact arm 2, which is mounted on the axis 3 of a rotor 4 such that it can rotate. The rotor 4 itself is mounted in a terminal housing or cassette (not shown) and has two diametrically opposed satellite axes

5 and 6, which are also rotated about the axis 3 when the rotor 4 rotates. The axis 5 is the point of engagement for a linkage 7, which is connected to a latch 8. The latch 8 is mounted, such that it can pivot, on an axis 10 positioned on the circuit breaker housing 9. In the event of an overcurrent or short circuit condition, the latch 8 is released by a latching mechanism 11, moving the contact arm 2 to the open position shown in FIG. 1.

The latching mechanism 11 can be actuated by a trip lever 13 that pivots about an axis of rotation 12. The other end of the trip lever 13 contacts a trip shaft 14, which is mounted on an axis 15 supported by the circuit breaker housing 9. Disposed on the trip shaft 14 is a cam 14*a*, which can be pivoted clockwise in opposition to the force of a torsional spring 14*b* wound about the axis 15.

Mounted to the circuit breaker housing 9 in the bottom region of the circuit breaker is a magnet yoke 16, which encircles a current carrying strap 17 electrically connected to one of the contacts of the circuit breaker 1. Arranged facing the magnet yoke is an armature element 18 in the form of a metallic lever, which is hinge-mounted by means of hinge pin sections 19 (see FIG. 3) to hinge knuckles (not shown) formed on the circuit breaker housing 9. The armature 18 is also connected to strap 17 by a spring 20, which biases the armature 18 in the clockwise direction, away from the magnet yoke 16. In its upper region, armature 18 is equipped with a clip 21 rigidly mounted thereon, which can be brought into contact with the cam 14*a* by pivoting of the armature in a counter-clockwise direction. Movement of cam 14*a* by the armature 18 causes the trip shaft 14 to rotate about axis 15 and thereby actuate the latching mechanism 11 by means of the trip lever 13. Once actuated, latching mechanism 11 releases latch 8 to initiate the tripping process in circuit breaker 1. While the clip 21 is described herein as being mounted to armature 18, the clip 21 can also be formed as one piece with the armature 18, preferably of metal.

Figure 2:
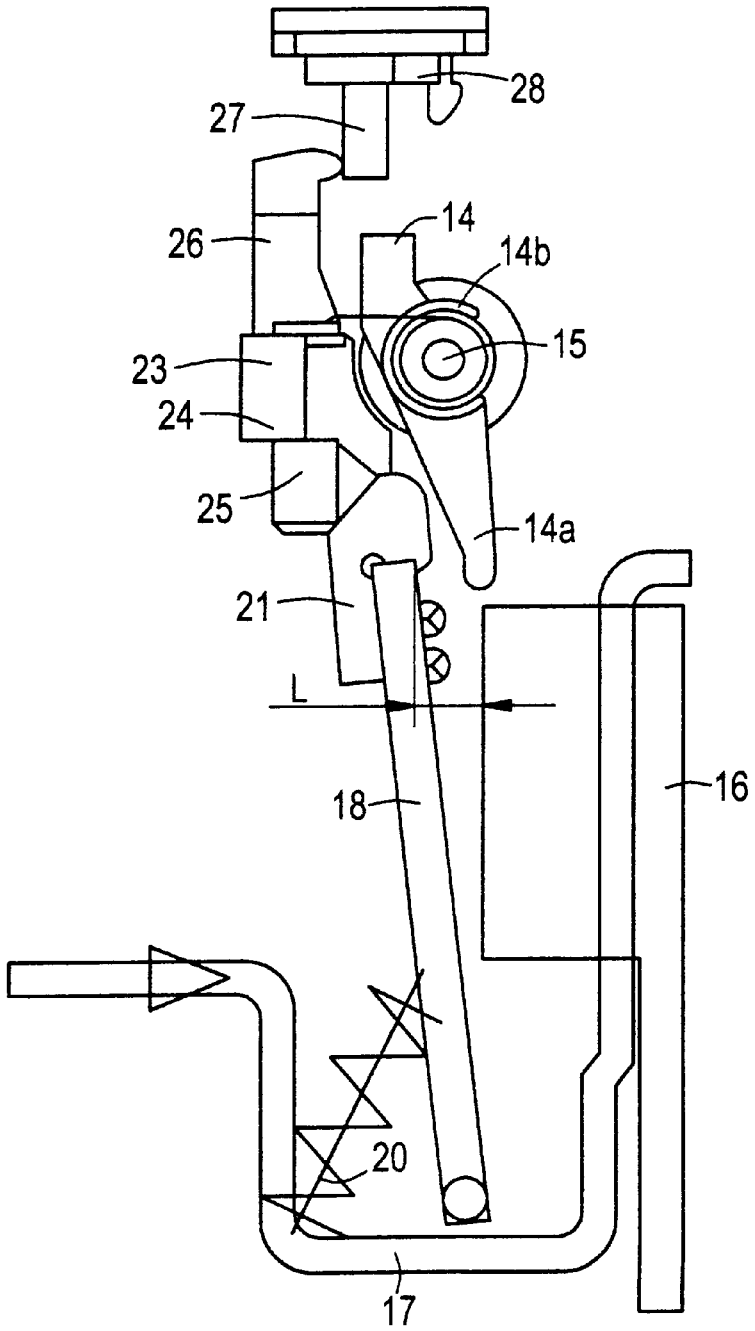
FIG. 2 is an elevation view of the magnetic trip unit from the circuit breaker of FIG. 1.
Figure 3:
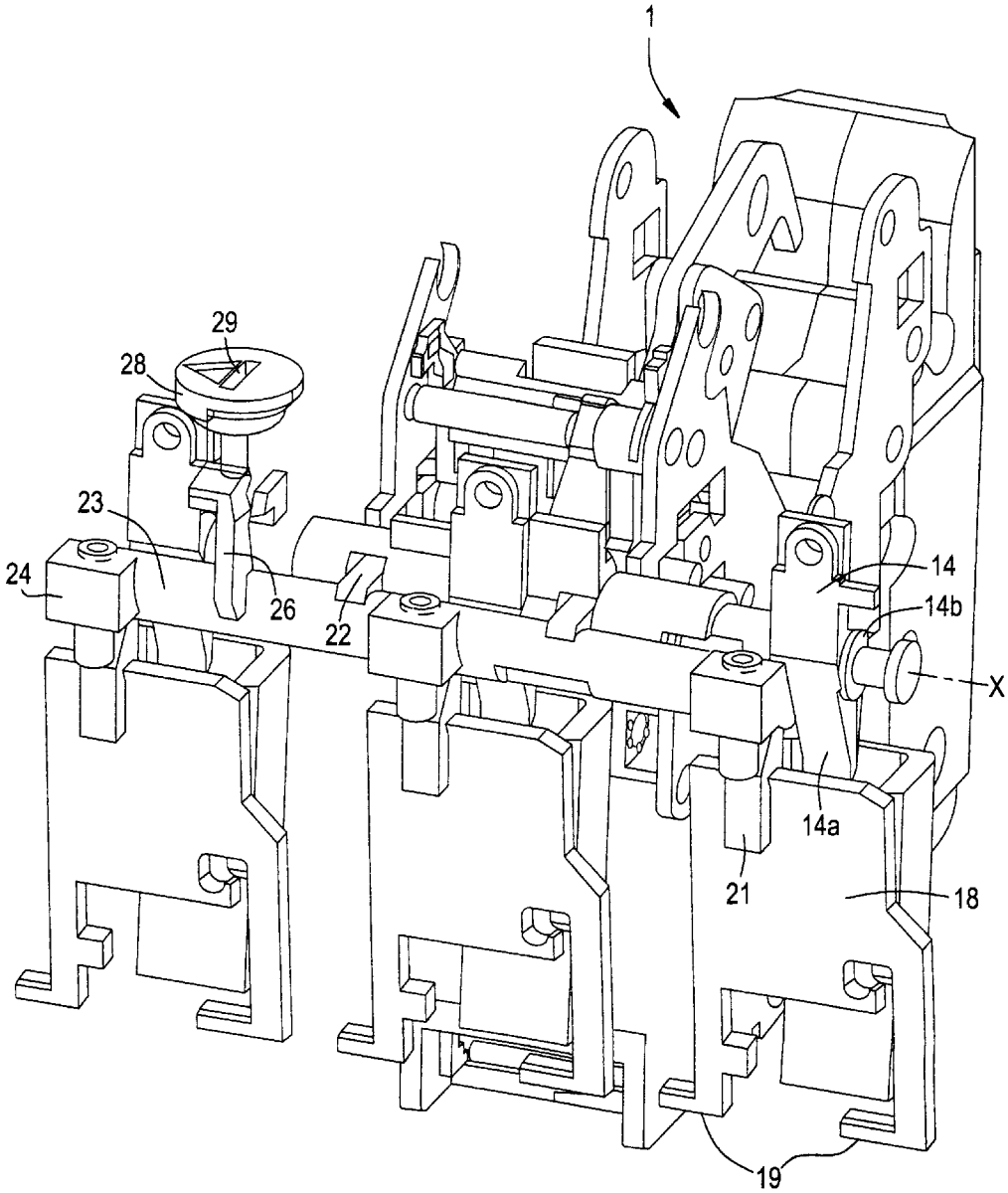
FIG. 3 is a perspective view of a multi-pole circuit breaker including the magnetic trip unit of FIG. 2.

Referring now to FIG. 2 and FIG. 3, an adjusting bar 23 extends parallel to the axis 15 and is mounted on the axis 15, by means of support arms 22. The adjusting bar 23 has an adjusting arm 24 which is threadably engaged to an adjusting screw 25 for calibrating the trip unit. Adjusting bar 23 also includes a lever arm 26 which extends to a side of the adjusting bar 23 diametrically opposite adjusting arm 24. The end of the lever arm 26 is in contact with a cam pin 27 of a rotary knob 28, which is mounted in a hole in the upper wall of the circuit breaker housing 9 (FIG. 1). The surface of the rotary knob 28 is equipped with a slot 29 to make it possible to adjust the rotary knob 28 with the aid of a suitable tool, such as a screwdriver.

In the unactuated state of the magnet yoke 16, which is to say when the contact arm 2 (FIG. 1) is closed and an overcurrent is not present, the adjusting screw 25 is in constant contact with an angled surface of the clip 21. Contact between adjusting screw 25 and the angled surface of the clip 21 is ensured by a tensile force exerted by the spring 20 on the armature 18. The force of the angled surface of the clip 21 on adjusting screw 25 biases the adjusting bar 23 in a clockwise direction about axis 15, thus forcing lever arm 26 away from yoke 16 and against pin 27. In this state, it is possible to change the tilt setting of the armature 18 either by extending (or retracting) adjusting screw 25 downward from (upward to) adjusting arm 24, or by rotating the adjusting bar 23 about axis 15 by adjusting the rotary knob 28. Thus, the distance L shown in FIG. 2 between the flap 18 and the magnet yoke 16 is adjusted, thereby setting the current at which the trip unit responds.

One advantage of the present invention is that an extremely reliable adjustment mechanism is guaranteed by the interaction of the adjusting bar 23, which rotates around the axis 15 of the trip shaft 14, and the rotary knob 28 that interacts therewith via cam pin 27. Moreover, this mechanism is easy to produce and is compact in design. The tripping device of the present invention has only a few elements, which can be accommodated, in a space-saving manner, laterally in the switch.

The circuit breaker with adjustable magnetic trip unit shown in FIGS. 1, 2, and 3 operates as follows. First, a person adjusting the circuit breaker I by turning rotary knob 28 sets the position of the adjusting bar 23 on the axis 15 and thus the distance between the armature 18 and the magnet yoke 16, as shown in detail in FIG. 2. Because of the relatively greater length of the lever arm 26 as compared to the adjustable arm 24, the adjustment made by rotary knob 28 is fine. It must be noted here that a coarser adjustment of the distance L between the magnet yoke 16 and the flap 18 can be accomplished by turning the adjusting screw 25 during installation of the trip unit in the circuit breaker housing 9.

In the case of a short circuit, an overcurrent naturally occurs, which flows through the current carrying strap 17. This activates the magnet yoke 16 to the extent that when a specific current is exceeded, the magnetic force generated by the magnet yoke is sufficient to attract the armature 18 in opposition to the tensile force exerted by the spring 20. Armature 18 pivots towards yoke 16, and the cam 14*a* is pivoted clockwise in FIG. 1 (counter-clockwise in FIG. 2) by the clip 21 until the trip lever 13 is actuated. Actuation of the trip lever 13 then tilts the latching mechanism 11 such that it in turn can release the latch 8 for a pivoting motion, upward in FIG. 1, about the axis 10. This motion is caused by a spring, which is not shown in detail in FIG. 1. The motion of the linkage 7 that is coupled with the pivoting motion of the latch 8 brings about a rotation of the rotor 4 by means of the axis 5, and thus finally a disconnection of the contact arm 2 from the current carrying straps.

As shown in FIG. 3, the trip unit can be arranged for use in a circuit breaker 1 having a plurality of breaker cassettes 30, with each cassette 10 having its own contact arm 2 and rotor 4 arrangements. While only one cassette 30 is shown, it will be understood that one cassette 30 is used for each phase in the electrical distribution circuit. Adjusting bar 23 extends along the row of circuit breaker cassettes 30, parallel to the axis 15 of the trip shaft 14. Extending from adjusting bar 23 are several adjusting arms 24 corresponding to the number of circuit breaker cassettes 30. Also formed on the adjusting bar 23 is one lever arm 26, which is sufficient to rotate the adjusting bar 23 about axis 15 and, thus, pivot the armatures 18. The tripping sensitivity in each circuit breaker cassette 30 can be adjusted separately by means of the screws 25 carried by each adjusting arm 24. As a result, individual calibration of each circuit breaker cassette 30 can be undertaken independently of the adjustment of rotary knob 28.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

What is claimed is:

1. A magnetic trip unit for actuating a latching mechanism to trip a circuit breaker upon an overcurrent condition, the magnetic trip unit including:

a first electrically conductive strap;

a first magnet yoke disposed proximate to said first electrically conductive strap;

a first armature pivotally disposed proximate to said fist magnet yoke, said first armature and said first magnet yoke being separated by a first gap;

a trip shaft extending along an axis and configured to rotate about said axis and interact with the latching mechanism, said trip shaft having a first cam extending therefrom, said first cam being arranged proximate to said first armature; and an adjusting bar extending substantially parallel to said axis, said adjusting bar configured to rotate about said axis independently of said trip shaft, said adjusting bar including a first adjusting arm extending therefrom, said first adjusting arm contacting said first armature for adjusting said first gap between said first magnet yoke and said first armature.

2. The magnetic trip unit of claim 1, further including:

a rotary knob; and a cam pin extending from said rotary knob, said cam pin contacting a lever arm extending from said adjusting bar.

3. The magnetic trip unit of claim 1, wherein said first adjusting arm includes an adjusting screw threadably engaged thereto, said adjusting screw contacting said first armature.

4. The magnetic trip unit of claim 1, further including:

a second electrically conductive strap;

a second magnet yoke disposed proximate to said second electrically conductive strap;

a second armature pivotally disposed proximate to said second magnet yoke, said second armature and said second magnet yoke being separated by a second gap; and wherein said trip shaft includes a second cam extending therefrom, said second cam being arranged proximate to said second armature, and said adjusting bar includes a second adjusting arm extending therefrom, said second adjusting arm contacting said second armature for adjusting said second gap between said second magnet yoke and said second armature.

5. The magnetic trip unit of claim 2, wherein said lever arm is arranged diametrically opposite said first adjusting arm and offset therefrom.

6. The magnetic trip unit of claim 3, wherein said armature includes a clip disposed on a free end of said armature, said clip having an angled surface formed thereon for contacting said adjusting screw.

7. A circuit breaker including:

a first contact arm arranged between first and second electrically conductive straps;

a latching mechanism operatively connected to said first contact arm a first magnet yoke disposed proximate to said first electrically conductive strap;

a first armature pivotally disposed proximate to said fist magnet yoke, said first armature and said first magnet yoke being separated by a fist gap;

a trip shaft extending along an axis and configured to rotate about said axis and interact with the latching mechanism, said trip shaft having a first cam extending therefrom, said first cam being arranged proximate to said first armature; and an adjusting bar extending substantially parallel to said axis, said adjusting bar configured to rotate about said axis independently of said trip shaft, said adjusting bar including a first adjusting arm extending therefrom, said first adjusting arm contacting said first armature for adjusting said first gap between said first magnet yoke and said first armature.

8. The circuit breaker of claim 7, further including:

a rotary knob; and a cam pin extending from said rotary knob, said cam pin contacting a lever arm extending from said adjusting bar.

9. The circuit breaker of claim 7, wherein said first adjusting arm includes an adjusting screw threadably engaged thereto, said adjusting screw contacting said first armature.

10. The circuit breaker of claim 7, further including:

a second contact arm arranged between third and fourth electrically conductive straps;

a second magnet yoke disposed proximate to said third electrically conductive strap;

a second armature pivotally disposed proximate to said second magnet yoke, said second armature and said second magnet yoke being separated by a second gap; and wherein said trip shaft includes a second cam extending therefrom, said second cam being arranged proximate to said second armature, and said adjusting bar includes a second adjusting arm extending therefrom, said second adjusting arm contacting said second armature for adjusting said second gap between said second magnet yoke and said second armature.

* * * * *